US006352307B1

(12) United States Patent
Engman

(10) Patent No.: US 6,352,307 B1
(45) Date of Patent: Mar. 5, 2002

(54) MULTIPOSITIONING SYSTEM SEAT

(75) Inventor: Bo Engman, Sundsbruk (SE)

(73) Assignee: Permobil AB, Timra (SE)

( * ) Notice: Subject to any disclaimer, the term of this patent is extended or adjusted under 35 U.S.C. 154(b) by 0 days.

(21) Appl. No.: 09/076,917

(22) Filed: May 13, 1998

Related U.S. Application Data

(63) Continuation of application No. PCT/SE96/01487, filed on Nov. 15, 1996.

(51) Int. Cl.[7] ..... A47C 3/025

(52) U.S. Cl. ..... 297/284.11; 297/452.4; 297/284.1; 297/423.3; 297/353; 297/411.35; 297/DIG. 4

(58) Field of Search ..... 297/411.29, 411.32, 297/354.12, 228.13, 284.3, 284.1, DIG. 4, DIG. 6, 284.11, 327, 353, 440.24, 440.1, 423.26, 423.3, 423.4, 374, 411.35, 411.38, 440.16, 375, 376, 452.4, 440.2, 440.21; 280/304.1; 403/87, 101; 16/239, 249

(56) References Cited

U.S. PATENT DOCUMENTS

| | | | | | |
|---|---|---|---|---|---|
| 433,836 | A | * | 8/1890 | Van Slyke | 297/423.24 X |
| 1,432,612 | A | * | 10/1922 | O'Connor | |
| 2,045,225 | A | * | 6/1936 | Glasgow | |
| 2,147,439 | A | * | 2/1939 | Herold | |
| 2,740,465 | A | * | 4/1956 | Mugler | 297/374 X |
| 3,658,382 | A | * | 4/1972 | Anderson | |
| 3,759,572 | A | * | 9/1973 | Koepke | 297/452.4 |
| 3,937,490 | A | | 2/1976 | Nasr | |
| 4,118,069 | A | * | 10/1978 | Hunter | 297/411.29 |
| 4,375,295 | A | | 3/1983 | Volin | |
| 4,401,343 | A | * | 8/1983 | Schmidt | |
| 4,457,535 | A | | 7/1984 | Takeuchi et al. | |
| 4,500,109 | A | | 2/1985 | Volin | |
| 4,592,570 | A | * | 6/1986 | Nassiri | 297/DIG. 4 X |
| 4,593,929 | A | * | 6/1986 | Williams | 297/DIG. 4 X |
| 4,629,246 | A | * | 12/1986 | Fulton | |
| 4,647,066 | A | * | 3/1987 | Walton | 297/DIG. 4 X |
| 4,770,432 | A | * | 9/1988 | Wagner | 297/DIG. 4 X |
| 4,876,755 | A | * | 10/1989 | Parrish | 297/284.3 |
| 5,020,816 | A | * | 6/1991 | Mulholland | 297/DIG. 4 X |
| 5,209,509 | A | * | 5/1993 | Gay et al. | 297/DIG. 4 X |
| 5,228,747 | A | * | 7/1993 | Greene | 297/DIG. 4 X |
| 5,322,349 | A | * | 6/1994 | Gianino | 297/DIG. 6 X |
| 5,328,246 | A | * | 7/1994 | Sereboff | |
| 5,380,063 | A | * | 1/1995 | Dauphin | |
| 5,547,259 | A | * | 8/1996 | Fredrick | 297/452.4 X |
| 5,564,786 | A | * | 10/1996 | Peek et al. | 297/452.4 |
| 5,944,385 | A | * | 8/1999 | Pearce | |

FOREIGN PATENT DOCUMENTS

| | | | | |
|---|---|---|---|---|
| GB | 555632 | * | 8/1943 | 297/376 |
| SE | 402706 | | 7/1978 | |

* cited by examiner

*Primary Examiner*—Milton Nelson, Jr.
(74) *Attorney, Agent, or Firm*—Nixon & Vanderhye P.C.

(57) ABSTRACT

A seat, for example, a wheelchair, comprises a seat part, a backrest part, armrests, and footrests. The seat part and the backrest part have a commonly adjustable width, e.g. the side support portions can essentially be inserted into portions of a central frame part, and transversal bars in the backrest have adjustable widths. The seat part also has adjustable front and rear edges, obtained by adjusting adjustable front and rear support portions. The inclination of the backrest is adjusted by clamping screws mounted in side plate portions provided with slots. The height of the backrest can also be adjusted by displacing an upper portion thereof. The inclination of the footrests is varied by moving hinges having a large frictional force normally holding them stationary.

35 Claims, 5 Drawing Sheets

MULTIPOSITIONING SYSTEM SEAT

CROSS REFERENCE TO RELATED APPLICATION

This is a continuation under 35 USC §111(a) of PCT/SE96/01487 filed Nov. 15, 1996.

FIELD OF THE INVENTION

The present invention relates to a seat or a chair unit intended primarily for vehicles of the wheelchair type and in particular motor-driven wheelchairs.

BACKGROUND OF THE INVENTION

Wheel chairs are often intended to be capable of being used for persons having different bodily constitutions, bodies of varying sizes and varying handicaps. Thus there exists a need for being able to adjust the dimensions of the seat in a simple way, included therein also the dimensions of a backrest included in the seat. Also, the slope and the position of portions such as the seat cushion, footrests and armrests need to be capable of being adjusted.

Such a wheelchair is for example disclosed in U.S. Pat. No. 3,937,490 (corresponds to SE-B 402 706) and has two side frames, the distance of which from each other can be adjusted, so that the wheelchair gets different widths. Then at the same time, the distance of the wheelchair wheels of each other is changed and also the width of the seat and of the backrest, implying that they cannot be adjusted individually. The position of the backrest in relation to the front edge of the seat can also be adjusted. The backrest and the seat are made of flexible web pieces. Similar designs are disclosed in U.S. Pat. Nos. 4,375,295, 4,457,535 and 4,500,109.

However, such designs cannot be used for seats or chair upper units which are intended for motorized wheelchairs. They require a seat or a chair unit attached to the motor-driven base and in addition, generally padded cushions in the backrest and in the seat in order to provide a suitable comfort. Further, the padded cushions should then have a rigid base or a rigid bottom plate ensuring the comfort. The width and height of such cushions and the rigid bases thereof must in a simple way be capable of being adjusted to be adapted to different users.

DESCRIPTION OF THE INVENTION

It is an object of the invention to provide a seat, in particular a chair unit including a seat or bottom unit, against the upper surface of which the buttocks of a person is intended so to rest, and a backrest part, which is suited for different mountings, e.g. on a motor-driven base, and is adjustable in a simple manner in a multitude of ways.

It is a further object to provide a rigidly constructed seat, the total width and depth of which can be adjusted.

These and other objects are achieved with the device as described hereinafter including that the seat part comprises a central frame attached to a fixture which is intended to be attached to a wheelchair base, which can be a motorized base for a wheelchair, and side frames arranges at each side of the central frame, which are adjustably attached to the central frame. Then, by a varying adjustment of the side frames different widths of the seat part are obtained. The side frames support advantageously thin rigid seat plates or base plates, which at least at their outermost portions located at the sides rest primarily on one of the side frames. The seat plates are slidable on top of or at the bottom of each other when changing the width of the seat part, such as when adapting the side frames in relation to the central frame. The seat plates then carry padded cushions, the sizes of which can also be varied.

Further, the seat part can be adjusted in varying angles of inclination by means of a lower frame which is rigidly attached to the fixture and placed under the central frame and is hinged thereto, for example at the rear edge thereof, and an adjustment mechanism, for example a screw cooperating with a threaded bore, connected to the lower frame and the central frame, so that the central frame is adjusted in different angles in relation to the lower frame and thereby also the slope of the seat part is varied.

Further, a front frame can be provided, which is arranged at the front side of the central frame and is adjustably attached to the central frame, and/or a rear frame, which is arranged at the rear side of the central frame and is adjustably attached to the central frame. Then, by adjusting the front or the rear frame respectively, the front edge and the rear edge respectively of the seat part can be placed in different positions in relation to the fixture and thereby in relation to the seat base. The position of the centre of gravity of a person resting in the chair can thereby be adjusted in relation to the fixture. Further, thin seat plates of the type mentioned above can be adjustably attached to the front frame and/or the rear frame in order to be secured in their positions and obtain support from these frame parts.

The backrest comprises preferably two side frame portions which are attached to the corresponding side frames of the seat part. The side frame portions are connected by intermediate frame portions or cross frame portions which are attached to the side frame portions. The intermediate frame portions have adjustable lengths, so that in adjusting the side frames of the seat the length of the intermediate frame portions can be adapted thereto, so that the width of the backrest is adjusted in accordance with the width of the seat part. The side frame portions are attached to the side frames of the seat by means of hinged connections which are adjustable as to their angles. Then, these connections comprise a suitable locking mechanism for adjusting the inclination of the backrest in relation to the seat. Such a locking mechanism can comprise a first slot in a first part, such as a plate, which is rigidly attached to the backrest, and a second slot in a second part, such as a second plate, which is rigidly attached to the seat part. The second slot is then arranged so that it with its direction, which is defined by the edges of the slot, or its longitudinal axis in the geometrical sense intersects the direction of the first slot, which is defined by the edges of the slot, or its longitudinal axis so that a hole passing through the two slots is formed. Then, a locking element such as a locking screw can pass through the hole thus formed for locking the backrest in relation to the seat part. The directions of the slots are advantageously arranged in such a way that also when the locking element is located in the hole and it is not arranged for a firm or positive locking operation still a resistance is obtained when changing the angle of the first and second parts, i.e. when changing the inclination of the backrest, owing to a large friction between the edges of the slots and the locking element. The geometrical angle of intersection between the slots or their directions and/or between their edges can for example always be less than 45° for different possible inclinations of the backrest.

Advantageously the joints between the side frame portions of the backrest and the side frames of the seat part are attachable in different positions in the longitudinal direction of the seat, i.e. along the exterior sides or edges of the side frames of the seat. In this way the position of the backrest in a direction forwards and backwards in relation to the seat part can be adjusted for adapting to e.g. a changed position of the rear edge of the seat part.

Also the height of the backrest can be adjusted and it is accomplished by the fact that it can comprise a lower frame portion and an upper frame portion which upper frame portion is attachable to the lower frame portion in different positions in the vertical direction. In addition, the upper frame portion can also be removed so that a considerable reduction of the height of the chair upper part is obtained. This can be advantageous in transporting the chair upper part. Rigid base plates for the backrest are then suitably attached to the upper frame portion and have detachable hook means for a detachable cooperation with the lower frame portion. Such backrest plates comprise advantageously two plates, which at their outermost portions located at the sides rest primarily on one of the side frame portions of the backrest. These plates are like the base plates in the seat part interlockable and slidable on top of or at the bottom of each other when changing the width of the backrest, what can be required when changing the distance of the side frame portions of the backrest.

Further, armrests can be attached to the backrest, as by means of a hinge formed by a pivot in a hole. By means of a suitably constructed pivoting mechanism they can be detached from the backrest by a rotating movement upwards to a position substantially parallel to the backrest and thereupon a displacement horizontally. Such a mechanism can comprise a slot cooperating with some suitable projecting element, such as a pin or a plate, so that in the rotating movement the slot will be disengaged from the projecting element, whereas it is engaged therewith in the normal, approximately horizontal position of the armrest or the position of the armrest that is parallel to the seat part. The slot and the projecting element should be attached to the seat part and the backrest respectively or to the backrest and to the seat part respectively. Further, the rotating joint must allow the armrest to be moved freely in a horizontal direction, i.e. perpendicularly to the plane of the rotation, away from the backrest in the case when the slot and the projecting element are disengaged from each other.

Foot- and/or legrests can be attached to the seat part by means of a hinge and a locking mechanism applied in the hinge for adjusting the slope of the rests in relation to the seat. The locking mechanism comprises advantageously a friction joint comprising a multitude of parallel, plate-shaped elements rigidly attached to the seat part and a multitude of parallel plate-shaped elements rigidly attached to the foot- and/or legrest, so that the plate-shaped elements are arranged alternatingly with each other. Further, a through-hole passes through the plate shaped elements, through which hole a common shaft extends, so that the hinge is formed. Further, means are provided for pressing the plate-shaped elements against each other, e.g. by the shaft comprising a screw or bolt together with a cooperating threading or nut.

The cushions in the seat part and the backrest can comprise a padded part having slots, which extend at and in parallel with edges of the padded part, so that edge portions of the padded part located at the side of or outside the slots can be easily removed. In that way, the padded part is reduced and thereby the width and/or length of the cushion for adaption to an adjusted value of the width of the seat part. The cushion can also comprise a cover of a flexible thin material such as some fabric or plastics material arranged outside the padded part. The cover is advantageously provided with velcro strips (bur fasteners) and counterstrips arranged at suitable places. When such a velcro strip is brought in contact with a suitably chosen corresponding counterstrip the marginal portion of the cover is folded onto itself. Thereby the width and/or the length of the cover can be reduced in order to be adapted to a reduced size of the padded part.

DESCRIPTION OF THE DRAWINGS

The invention will now be described by way of a non-limiting embodiment of the invention with reference to the accompanying drawings in which.

PREFERRED EMBODIMENT

Figure 1:
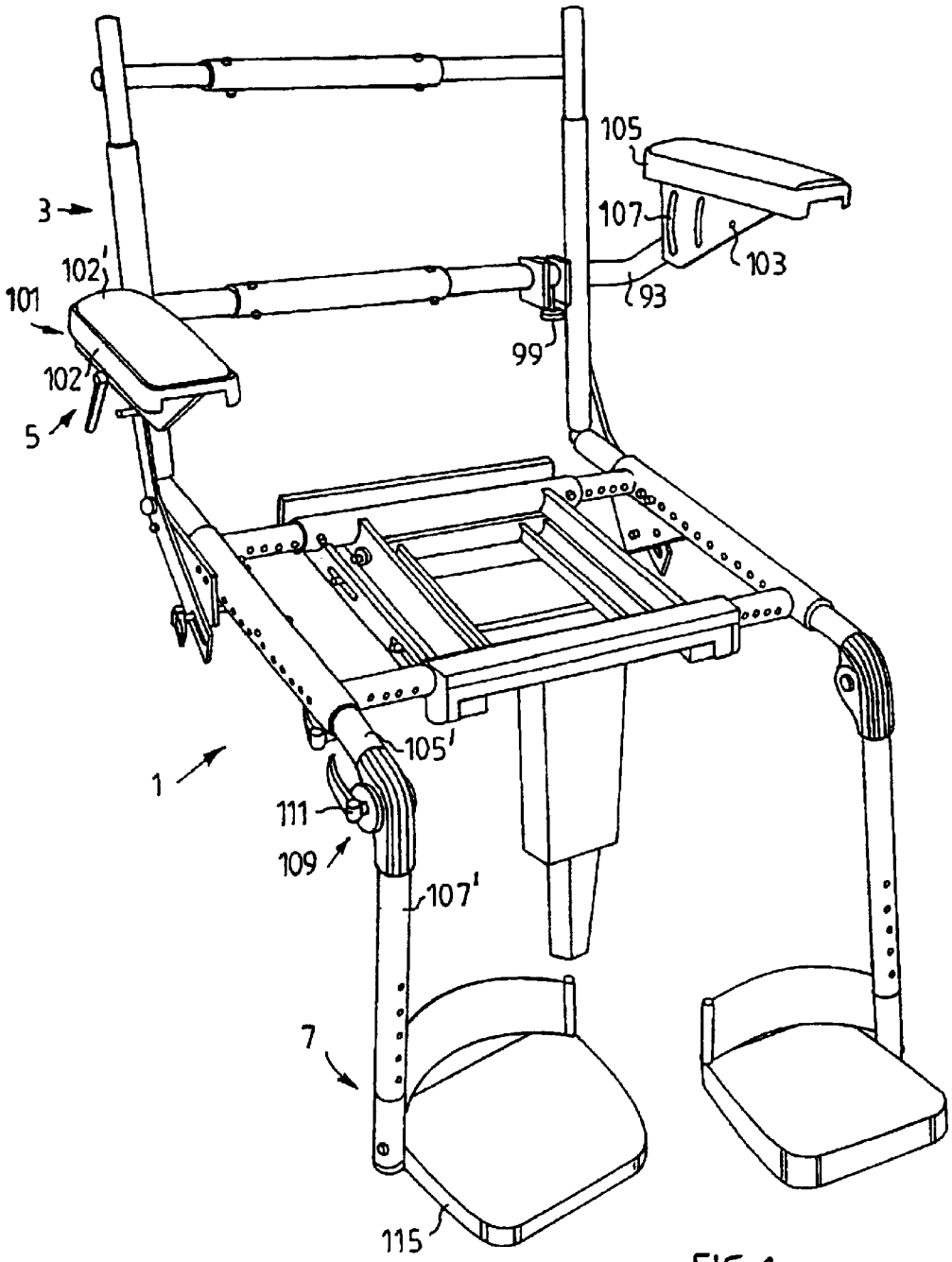
FIG. 1 is a perspective view seen obliquely from the front and from above of a seat or a chair for a motorized wheelchair.

In FIG. 1 a perspective view is shown of the frame for a seat or a chair unit intended primarily for a wheelchair, in particular to be mounted on the base of a motorized wheelchair having wheels and driving means for the wheels. The seat comprises a seat part 1, which is intended to support the buttocks of a person and portions of the hips, and a backrest part 3, which is intended to support the back portion of the person. Armrests 5 are attached to the backrest part 3, one armrest at each side. Further, foot- or legrest parts 7 are provided, one at each side, which are attached to the seat part 1 and projects from the front edge thereof. The seat part 1 comprises a frame structure having side portions, the supporting frame portions of which have adjustable positions laterally. Further, it comprises front and rear frame portions, the positions of which can be adjusted in relation to a central frame portion in the longitudinal direction of the seat.

The width of the backrest part 3 is adjusted at the same time as the width of the seat part 1 is adjusted. The attachment points between the backrest part 3 and the seat part 1 are further adjustable in the forward or backward directions. The height of the backrest part 3 is also adjustable.

Figure 2:
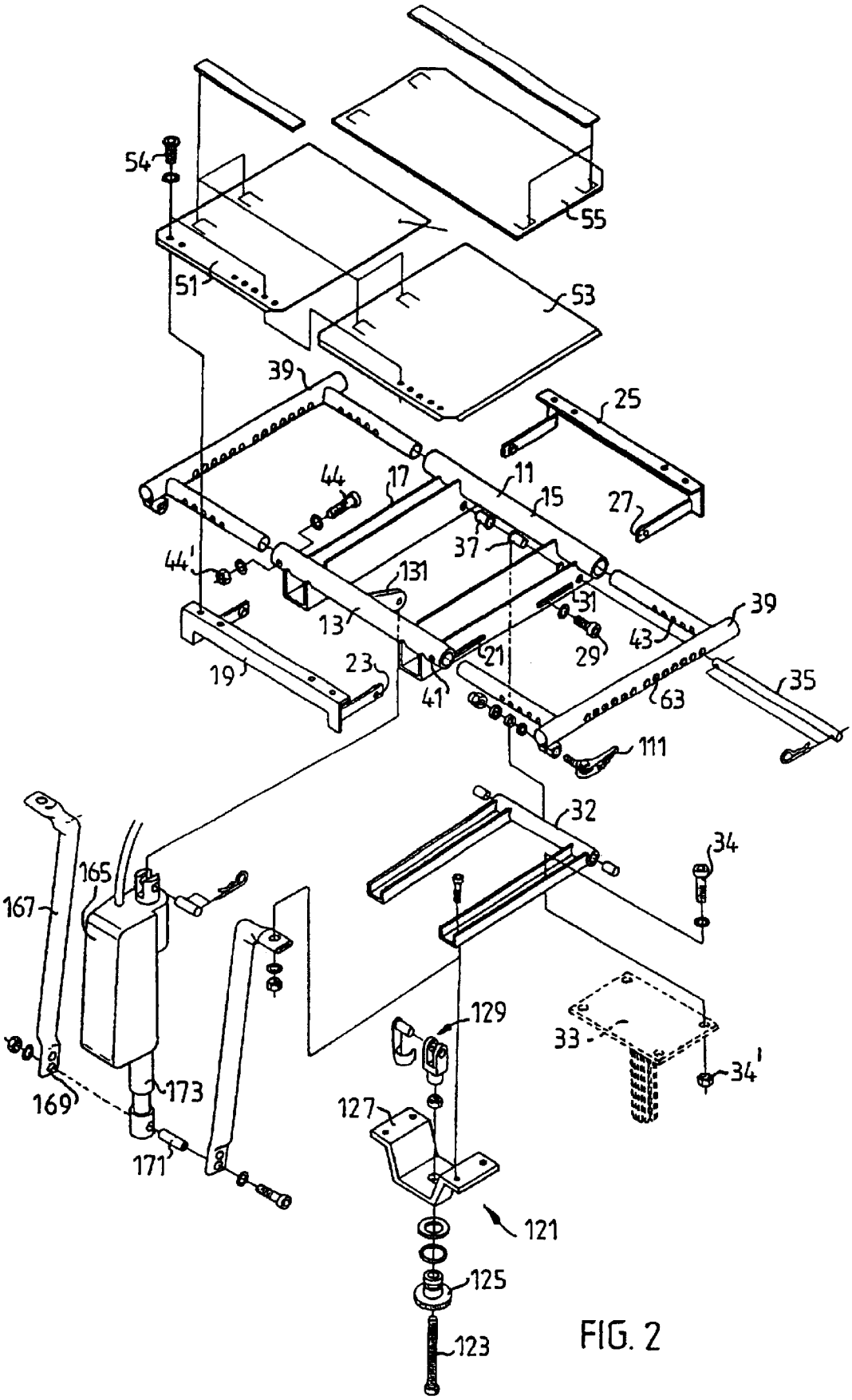
FIG. 2 is an exploded view of a seat part included in the chair unit of FIG. 1.

The central element of the seat part 1 is a central frame portion 11, see the exploded view of FIG. 2. The central frame portion 1 comprises a front transversal tube 13 and a rear transversal tube 15. The front and rear tubes 13 and 15 are connected by two U-shaped rails 17, which extend in the longitudinal direction of the chair and the web portions of which are located facing downwards and the outer legs of which are shorter than the interior legs. The U-rails 17 have suitable recesses in the legs thereof at their front and rear ends and are there attached to the tube portions 13 and 15, so that the U-rails end at the same level as the front and rear edge surface respectively of the front or rear tube portions respectively.

An adjustable front support portion 19 having the shape of a shallow U as seen from above is located having its legs inside the U-rails 17 adjacent to the outer legs or sides thereof. In the outer sides of the U-rails 17, which thus are located at the largest distance of the centre of the seat part, elongated slots 21 are provided. Through the slots screws 22 extend into threaded bores 23 in the outermost, rear ends of the legs of the front support portion 19. These screws 22 can be tightened in order to secure the support portion 19 in a suitable adjusted position, so that in the rearmost position the web portion of the support portion 19, which web portion projects from a plane passing through the legs of the U, can be located close to the front portion 13 of the central frame portion 11.

A rear frame portion 25 is designed in the same way to have legs, which project into the grooves of the legs of the U-rails 17 and are located at the outer legs of the rails. Threaded holes 27 in the rear support portion are intended to cooperate with screws 29 which extend through elongated openings or slots 32 in the outer sides of the U-rails 17. Thereby, also the rear support portion can be secured in an arbitrary position within certain limits in relation to the central frame portion 11.

For adjusting the width of the seat part 1 in a sideways direction side pieces or side frames 39 are arranged which have a U-shape as seen from above and consist of three steel tubes welded to each other. The legs of the U-shaped side support portions 39 extend into the front and rear tube portions 13, 15 of the central frame portion 11 and are attached thereto by the provision that bores 41 are made in the rear and front portions of the frame portion 11 and a number of bores 43 are made in the legs of the side support portions 39. Screws 44 can thus be placed in the bores 41 and 43 and be secured by nuts 44'.

The central frame portion 11 is hinged to a lower frame 31, which has a U-shape as seen from above and comprises a rear tube portion and two U-rails extending forwards. Through the rear tube portion of the lower frame 32 a shaft 35 extends which also extends through bores 31 passing through the U-rails 17 at the rear ends thereof directly at the rear tube portion 15 of the central, closed frame portion 11. The lower frame 32 is kept in its position centrally along the shaft 35 by means of bushings 37. The lower frame 32 is attached to the other part of the wheelchair, a support of which being shown at 33, by means of screws 34 and nuts 34' passing through holes drilled at suitable places.

Different seat plates are attached by means of screws to the rear and front support portions 25 and 19 respectively. Thus, two front plates 51 and 53 are provided which have a generally rectangular shape and have holes drilled at suitable places at their edges facing forwards in order to be attached to the front support portion 19 by means of screws 54 in threaded bores therein. A rear plate 55 also having a generally rectangular shape can in the same way be attached by means of screws in the rear support portion 25.

Figure 3:
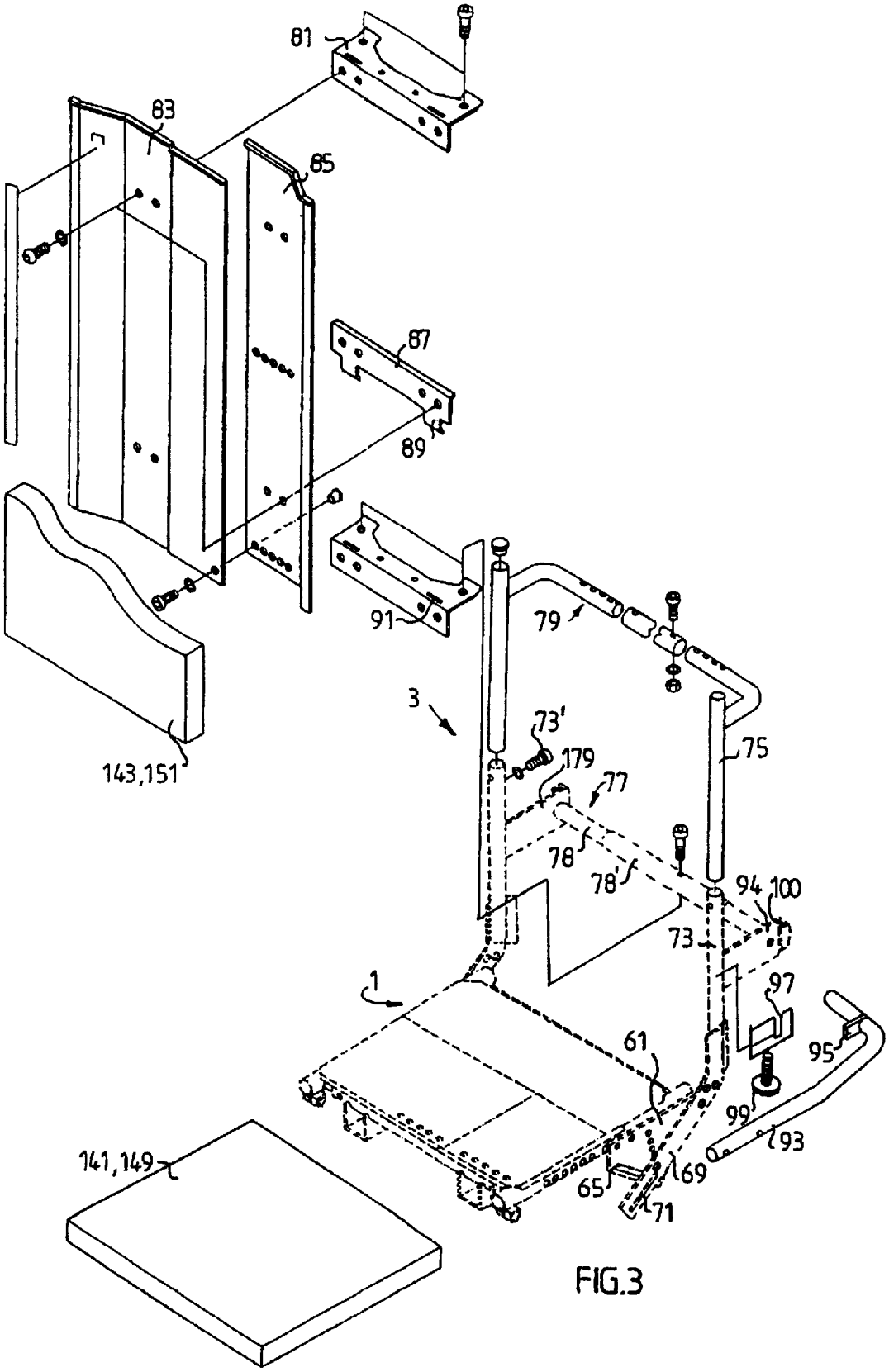
FIG. 3 is an exploded view of a backrest part included in the chair unit of FIG. 1.
Figure 4:
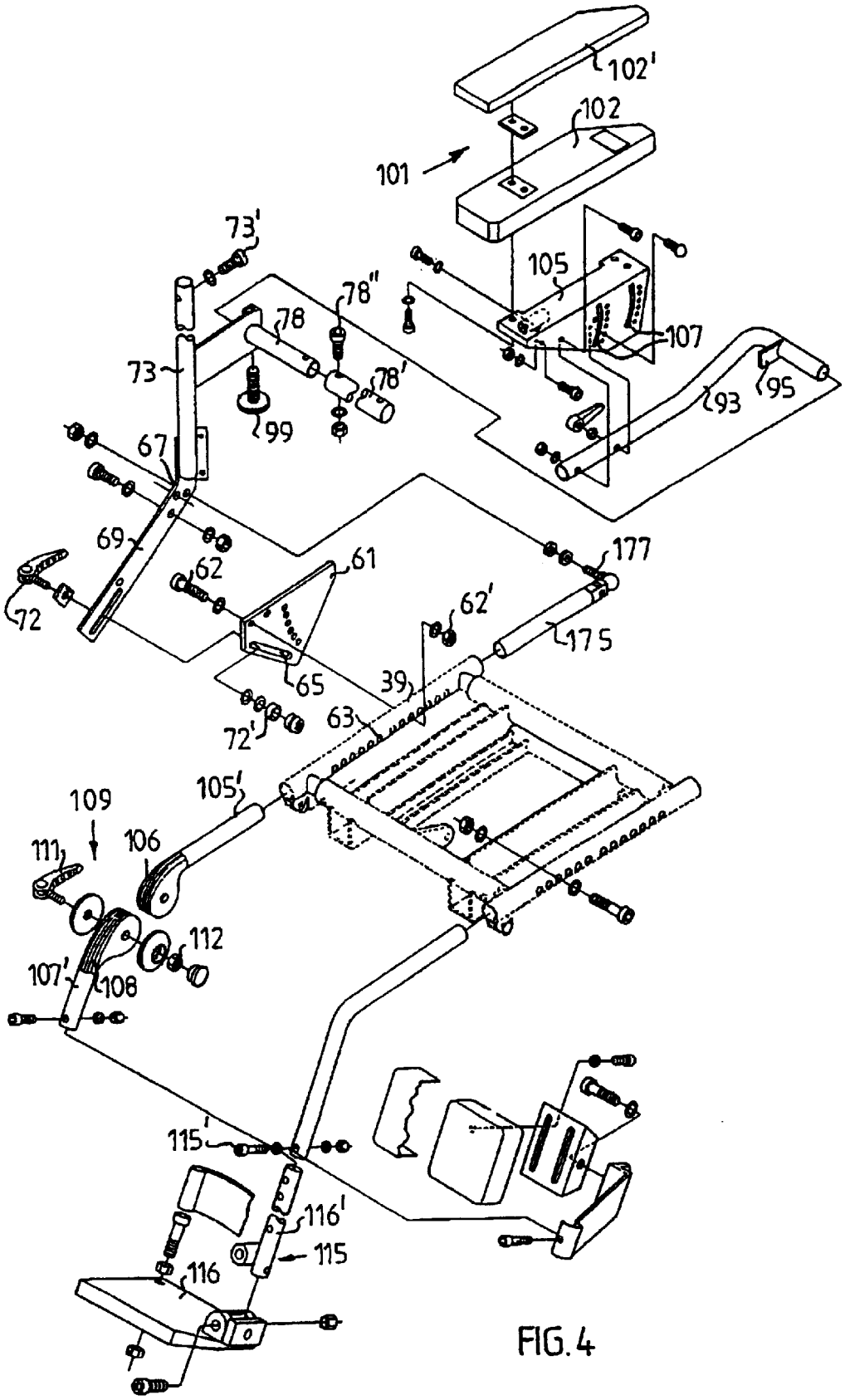
FIG. 4 is an exploded view of an armrest and a foot- and legrest included in the chair unit of FIG. 1.
Figure 6:
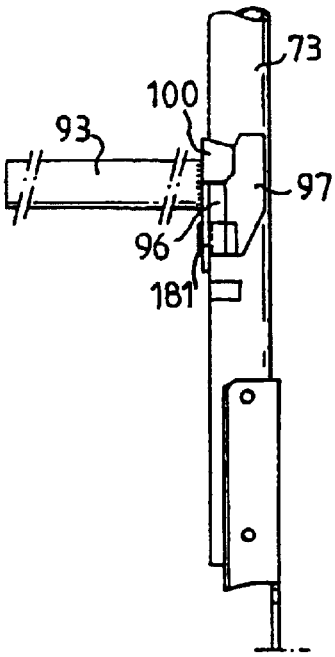
FIG. 6 is a front view of the hinged connection of FIG. 5, FIGS. 7*a* and 7*b* are schematic perspective views of the interior part and the cover of a seat cushion.

The backrest part 33 is attached to the side support portions 39 and particularly to the outer web portions thereof and the rear ends thereof, see FIGS. 3 and 4. Therefor, plates 61 are attached to the web portions by means of screws 62 and nuts 62' extending through holes in the plate pieces 61 and through suitable ones of a multitude of holes 63, which are drilled along a line in the web portions of the side support portions 39. Thereby, the plate pieces can be placed in positions which are adjustable in the longitudinal direction of the seat or in the forward direction. The plate support portions 61 have the shape of triangles, the front points of which are cut off and for which a side is parallel to the web portions of the side support portions 39. At the free oblique side of the triangle which connects to this cut-off corner, a slot 65 is made. At the rear point of the triangle a hinge 67 is provided which is formed by rear adjustable support tubes 175 cooperating with a plate portion 69, that has the shape of an angle, where the hinge 67 is located in the longer angle leg, at a small distance from the point of the angle. The support tubes 175 are inserted in the web portions that are located at the sides and belong to the side frames 39 of the seat and are maintained in suitable positions by means of the same screws which secure the triangular plates 61. At their rear ends the support tubes 175 have pins 177 projecting to the sides, which are inserted into holes in the angular plate portions 69 in order to form the hinges 67. In the exterior end of the longer angle legs of these portions a slot 71 is provided. This slot 71 cooperates with the slot 65 in the triangular plate support portion 61, so that a knob 72 or a screw having a handle can extend through these slots and be secured by means of nuts 72' or similar devices in order to set the angular plate portion 69 in different angular positions in relation to the seat part 1.

The slot 71 in the angular side plate 69 and the slot 65 in the triangular side hinge plate 61 have further been given suitable directions in relation to each other, so that in the case where a screw or a similar device extends through the slots, they will have a large friction caused by the engagement of the slots with the screw and cannot easily change their angle in relation to each other, even in the case where they are not tightly pressed to each other what can occur in those cases where the nut of the screw has been loosened and thus is not firmly tightened. It is accomplished by having the directions of the slots in relation to each other all the time, during all conceivable changes of the angle of the backrest, be less than some suitably chosen angle, e.g. 45°.

The plate angles 69 are with their shorter angular legs connected to lower side tubes 75 included in side frame portions in the backrest part 3. Upper side tubes 73 extend into the lower side tubes 73 and are adjustable in relation thereto by means of a multitude of holes drilled therein for receiving screws which can be secured by means of nuts. The lower backrest side tubes 73 and the upper side tubes 75 are connected by U-shaped backrest elements or transversal bars 77 and 79 respectively, where they have adjustable widths, e.g. by the provision that they comprise side portions 78 made of a thinner tube and a central portion 78' made of a thicker tube, so that the thinner parts can extend into the thicker one. The parts can then be secured in relation to each other by means of screws 78" extending through a set of different holes drilled at suitable places.

The side portions 78 of the lower transversal bar 77 are secured to plates 179, which are directed backwards and which are attached to the lower side tubes 73 of the backrest. The side portions of the upper transversal bar 79 are instead bent perpendicularly at their portions located at the sides, where the bent portion extends forwards and is welded to the upper side tubes 75.

To each one of the upper and lower transversal backrest bars 79 and 77 respectively support plates 81 are attached. These support plates consist of elongated angle plates, one leg of which is located in parallel to a plane extending through the backrest. The other leg portion is attached to the rear support tubes 79 and 77. The backrest part 3 also comprises back plates 83 and 85, which are intended to be secured to each other having a line of separation extending in the direction of the backrest from the bottom upwards. They are secured to each other by means of screws and nuts extending through several sets of corresponding holes, so that the composite back plate can be given different widths in accordance with the adjusted width of the total backrest part 3 and the seat part 1. The composite back plate 83, 85 is attached to the upper angle plate 81, which is attached to the upper transversal support part 79 in the backrest by means of screws in corresponding bores. At the bottom, at the rear side of these back plates also a rear support plate 87 is mounted which is hooked into the angle plate 81 that is attached to the lower transversal backrest bar 77, by the fact that the support plate 87 has tongues 89, which are directed downwards and extend into corresponding slots 91 in the lower portion of the support plate 81, that is attached to the lower transversal backrest portion 77. Thereby, it is possible to remove the upper portion of the backrest part 33 in a simple way, by pulling the side tubes 75 and the upper transversal U-shaped bar 79 together with the two back plates 83 and 85 and detaching them both from the lower side tubes 73 in the backrest part and from the slots 91 in the lower support plate angle 91.

Figure 5:
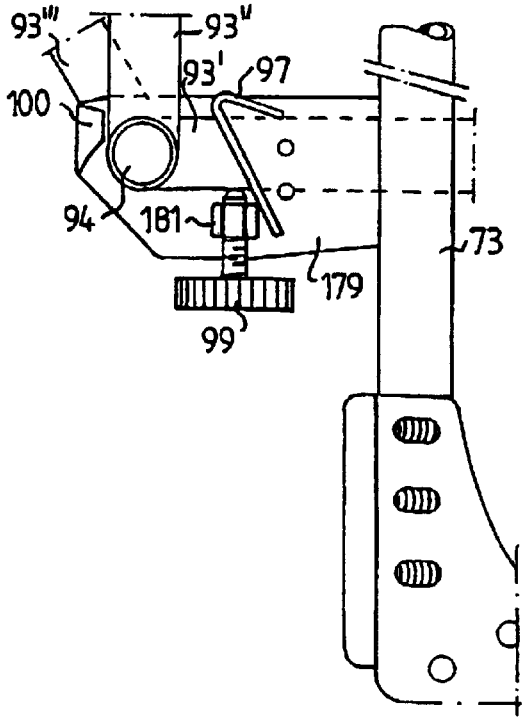
FIG. 5 is a view from the side of a hinged connection between an armrest and a backrest.
Figure 8A:
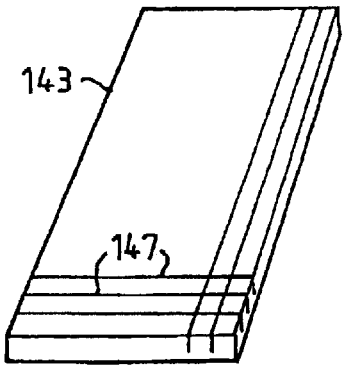
FIGS 8*a* and 8*b* are schematic perspective views of the interior part and the cover respectively of a back cushion.
Figure 8B:
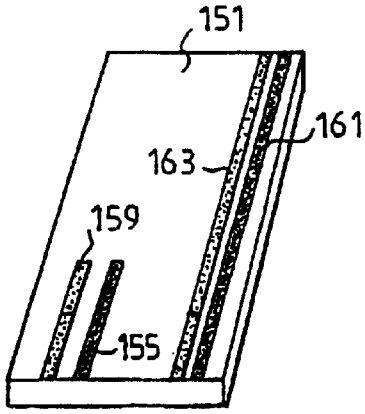
Figure 7A:
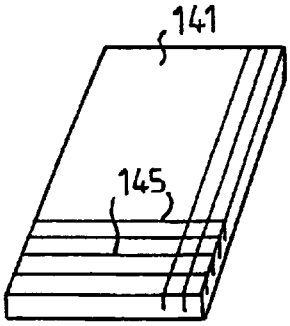
Figure 7B:
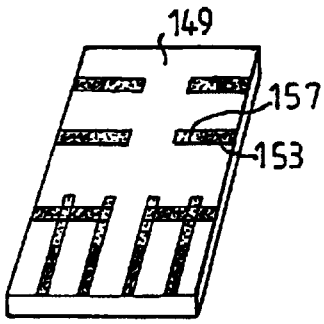

The armrest parts 5 comprise a bent tube 93, the rear end of which, which is bent in an angle of 90° in relation to the rest thereof, can be inserted into holes 94 in the thinner, outer tube portions 78 of the rear part of the lower backrest bar 77, see also FIG. 5. The tube 93 is obstructed from being detached from the tube portions 78 by bringing a plate portion 95 attached to the rear bent end of the tube 93 downwards to match in a slot 96 in a bent plate piece 97 attached to the plates 179, which are directed backwards and are included in the lower transversal bar 77 and are attached to the lower upstanding tubes 73 of the backrest. Underneath the plate piece 97 a block 181 is provided, through the threaded bore of which a screw 99 having a handle extends, so that the screw 99 with its upper end surface engages the underside of the armrest tubes 93. By turning the screw 99 the armrest 5 can be adjusted in different angles. The normal position of the armrest tube 93 when being used is illustrated at 93' in FIG. 5. It can be swung upwards to a position indicated at 93" that is approximately parallel to the backrest. Thereby, the plate 95 of the armrest portion 93 that is directed forwards gets free of the slot 96 and then the armrest parts can be pulled laterally from the chair, out from the holes 94 in the rear lower transversal bar 77. In this way the whole armrest part 5 can easily be detached from the other parts of the chair unit. If the armrest tube 93 is swung even more backwards, to the position illustrated at 93" in FIG. 5, instead the plate 95 engages behind flanges 100 directed forwards of the plate portions 179 of the lower transversal bar 77, so that in the corresponding position when the armrests 5 are folded backwards they are blocked.

The armrest parts 5 also comprise the proper armrests 101 including support portions 102 and soft cushions 102', which are arranged at the other end of the armrest tubes 93. The armrests 101 are adjustable within some angle, by the fact that they are hinged at the tube 93 by means of an hinges 103 and by the fact that they comprise inner plate portions 105 having slots 107, through which the screws can be inserted for cooperation with threadings in the side tubes 93.

Further, the armrests 101 are adjustable in two different positions in the longitudinal direction of the chair, by arranging two holes for the hinges 103 and by arranging two parallel slots 107.

The footrest parts 7 comprise in a preferred embodiment an upper tube 105' and an upper tube 107' directed downwards, which are connected to each other by means of a friction joint 109. The upper tube 105' is insertable in the outermost tube portions of the side support portions 63 of the seat part 1 and can be locked securely therein by means of a clamping screw, which is illustrated at 111 and cooperates with a nut 112. The friction joint 109 comprises a clamping screw 111 passing centrally through all of the hinge and through a multitude of parallel plates 106, 108 attached alternatingly to the upper tube 105' and to the lower tube 107', so that every second parallel plate 106 is attached to the upper tube 105' and every second one 108 is attached to the lower tube 107'. By this structure a very large friction is obtained in the rotary joint 109, so that it can be locked firmly in a desired position even for a moderate clamping pressure from the clamping screw 111. The footrest parts 7 also comprise the proper footrests 115, which comprise a support plate 116 attached to a lower tube 116' directed downwards, which is inserted in the lower tube 107' directed downwards and can be adjusted in relation thereto by means of a screw 115' passing through suitable holes in the tubes directed downwards.

The central frame 11 of the seat part can be set in an arbitrary angle within the interval of −5° to +7° in relation to the central lower frame 32 by means of a mechanism illustrated at 121, which provides a corresponding variation of the slope of the seat. It comprises a screw 123 which cooperates with a threaded washer 125, that is attached to a bent part 127. The bent part is attached to the lower main support part 32 and when turning the screw 23 the upper end of the screw is displaced, which by means of a hinge, shown at 129, cooperates with a projection 131 rigidly attached to the central frame part 11.

The slope of a seat can be adjusted within a larger interval, between −5° and +45°, in the case where an electric linear motor 165 is arranged instead of the screw 123 and the nut 125. In this case the bent part 127 can be replaced by two longer side supports 167, at the lower ends of which holes 169 are arranged, so that a shaft 171 can extend therethrough and through a hole in a rod 173 of the linear motor 165.

Cushions or pads can be arranged on the seat part 1 and on the backrest portion 3, see is FIGS. 7*a*–8*b*. They have adjustable outer dimensions by the provision that interior soft, elastic padding portions 141, 143 are provided with scores 145, 147, i.e. cuts, which do not pass all the way through the material of the padded portions, so that marginal portions can be easily removed from the main part of the padded portions. Further, on the cushions covers 149, 151 are arranged, which are sewn to have appropriate shapes and which can be changed to a smaller width or depth/length. It is accomplished by the method that marginal regions of the enclosures are folded towards the centre and in the folded-in position are attached by means of velcro strips 153, 155 which are sewn to the marginal portions of the covers and then are secured to counterstrips 157, 159, arranged farther in on the covers. The width of the cover 151 of the back cushion 143 can for example be changed by the method that an outer velcro strip 161, that extends in parallel to a long side and close thereto, is attached to an interior, parallel counterstrip 163 arranged at a larger distance of the long side.

What is claimed is:

1. A chair upper unit comprising:

a backrest, and a seat part having an upper surface which is adapted to engage the buttocks of a person seated in the chair upper unit, the upper surface defining a seat plane; and wherein at least one of said seat part and said backrest comprises thin stiff base plates forming a rigid base in a plane substantially parallel to the seat plane and a softer cushion disposed engaging said rigid base, said base plates being interconnected and slidable with respect to each other to adjust at least one of the width, depth and height of said rigid base.

2. The chair upper unit according to claim 1, wherein said softer cushion comprises a padded portion having scores, so that marginal portions of said padded portion, which are located at the side of said scores, can be removed in order to reduce at least one of the width and length of said padded portion and thereby at least one of the width and length of said softer cushion.

3. The chair upper unit according to claim 1, wherein said softer cushion comprises a cover of flexible material for a padded portion, said cover provided with hook and loop fastener strips and counterstrips disposed at suitable places, so that where a strip is placed against a counterstrip, a marginal portion of said cover is folded against itself, so that at least one of the width and length of said cover is reduced.

4. A chair upper unit comprising:

a backrest, and a seat part having an upper surface which is adapted to engage the buttocks of a person seated in the chair upper unit;

said seat part comprising:

a support attachable to a chair base;

a central frame connected to said support, and at least one of: a front frame at the front of said central frame and adjustably attached for displacement in a forward and backward direction to said central frame, and a rear frame at the rear of said central frame and adjustably attached for displacement in the forward and backward direction to said central frame, so that by adjusting the front or rear frame, respectively, in the forward and backward direction a front edge or a rear edge respectively of said seat part is placed in different positions with respect to said support in the forward and backward direction, and thereby with respect to said chair base, to which said support of the chair upper unit is attached, so that the position of the center of gravity of a person seated in the chair upper unit can be adjusted with respect to said support.

5. A foot and legrest for a chair upper unit having a seat part, said foot and legrest comprising:

a support attachable to said seat part;

a support frame;

a hinge attaching said support frame to said support; and a locking mechanism of said hinge which adjusts the inclination of said foot and legrest with respect to said seat part, said locking mechanism comprising a friction joint having a plurality of parallel first plate-shaped elements rigidly attached to said seat part and a plurality of parallel second plate-shaped elements rigidly attached to said foot and legrest, said first and second plate-shaped elements alternating with each other to provide an assembly of at least one inner plate-shaped element and of two end plate-shaped elements; and a hole passing through all said plate-shaped elements, through which a common shaft extends for forming said hinge; and a clamping mechanism which presses said plate-shaped elements against each other so that each inner plate-shaped element is pressed between two neighboring plate-shaped elements that are in direct mechanical contact with the inner plate-shaped element.

6. A chair upper unit comprising:

a backrest; and a seat part having an upper surface which is adapted to engage the buttocks of a person seated in the chair upper unit, said seat part comprising:

a support attachable to a chair base;

a central frame connected to said support and having first and second sides; and first and second side frames, said first side frame provided at said first side of said central frame, and said second side frame provided at said second side of said central frame, wherein each of said side frames is adjustably attached to said central frame so that by adjusting at least one of said side frames, the width of said upper surface of said seat part is changed; and first and second thin stiff plates forming said upper surface of said seat part, said first plate resting, at least at an outermost portion thereof, on said first side frame and said second plate resting, at least at an outermost portions thereof, on said side frame, said first and second plates being slidable with respect to each other when setting the width of said upper surface of said seat part by adjusting at least one of said side frames with respect to said central frame.

7. The chair upper unit according to claim 6, wherein said seat part further comprises:

a lower frame rigidly attached to said support, said lower frame positioned below said central frame and hinged to said central frame, and an adjustment mechanism connected to said lower frame and said central frame which adjusts said central frame to take different angles in relation to said lower frame.

8. A chair upper unit comprising:

a backrest; and a seat part having an upper surface which is adapted to engage the buttocks of a person seated in the chair upper unit, said seat part comprising:

a support attachable to a chair base;

a central frame connected to said support and having first and second sides; and first and second side frames, said first side frame provided at said first side of said central frame, and said second side frame provided at said second side of said central frame, wherein each of said side frames is adjustably attached to said central frame so that by adjusting at least one of said side frames, the width of said upper surface of said seat part is changed; and a lower frame rigidly attached to said support, said lower frame positioned below said central frame and hinged to said central frame, and an adjustment mechanism connected to said lower frame and said central frame which adjusts said central frame to take different angles in relation to said lower frame.

9. The chair upper unit according to claim 8, wherein said seat part further comprises a rear frame forming a rear edge of said seat part, said rear frame disposed at the rear of said central frame and adjustably connected to said central frame, so that by adjusting said rear frame said rear edge of said seat part is placed in different positions in relation to said support and thereby in relation to a chair base, to which the chair upper unit is attached, so that the position of the center of gravity of a person resting in said chair upper unit can be adjusted in relation to said support.

10. The chair upper unit according to claim 8, wherein said backrest comprises a lower frame portion and an upper frame portion, said upper frame portion being attachable in different vertical positions in a height direction in relation to said lower frame part, so that the height of said backrest can be adjusted.

11. The chair upper unit according to claim 8, wherein said backrest comprises a lower frame portion and an upper frame portion, said upper frame portion being detachably attached to said lower frame portion, so that second upper portion of said backrest can be removed for significantly reducing the height of said chair upper unit when transporting said chair upper unit.

12. The chair upper unit of claim 8, wherein said backrest comprises backrest side frame portions which are adjustably attached to each other so that the distance therebetween can be changed thereby changing the width of said backrest.

13. The chair upper unit of claim 12, wherein said backrest further comprises first and second thin stiff plates, said first plate primarily resting at a side of said chair upper unit, on said first backrest side frame portion, and said second plate primarily resting at a side of said chair upper unit on said second backrest side frame portion, said backrest plates or base plates being interconnectable and slidable with respect to each other to change the width of said backrest.

14. The chair upper unit according to claim 8, wherein the backrest comprises:

first and second backrest side frame portions, said first side frame portion attached to said first side frame of said seat part and said second side frame portion attached to said second side frame of said seat part; and backrest intermediate portions attached to said backrest side frame portions and connecting said backrest side frame portions to each other; and wherein said backrest intermediate frame portions have adjustable lengths so that in setting the width of said seat part by adjusting said side frames of said seat part the lengths of said backrest intermediate frame portions can be adjusted at the same time so that the width of said backrest is adjusted.

15. The chair upper unit according to claim 14, further comprising angularly adjustable hinged joints between said backrest side frame portions and said side frames of said seat part.

16. A chair upper unit comprising:

a backrest; and a seat part having an upper surface which is adapted to engage the buttocks of a person seated in the chair upper unit, said seat part comprising:

a support attachable to a chair base;

a central frame connected to said support and having first and second sides; and first and second side frames, said first side frame provided at said first side of said central frame, and said second side frame provided at said second side of said central frame, wherein each of said side frames is adjustably attached to said central frame so that by adjusting at least one of said side frames, the width of said upper surface of said seat part is changed; and a rear frame forming a rear edge of said seat part, said rear frame disposed at the rear of said central frame and being adjustably attached in a forward and backward direction to said central frame, so that by adjusting said rear frame in the forward and backward direction, said rear edge of said seat part is placed in different positions in relation to said support and thereby in relation to a chair base, to which the chair upper unit is attached, so that the position of the center of gravity of a person resting in said chair upper unit can be adjusted in relation to said support.

17. The chair upper unit according to claim 16, wherein said seat part further comprises first and second thin stiff plates forming said upper surface of said seat part, said first plate resting, at least at an outermost portion thereof on said first side frame, and said second plate resting, at least at an outermost portions thereof, on said side frame, said first and second plates being slidable with respect to each other when setting the width of said upper surface of said seat part by adjusting at least one of said side frames with respect to said central frame.

18. The chair upper unit according to claim 16, wherein said backrest comprises a lower frame portion and an upper frame portion, said upper frame portion being attachable in different vertical positions in a height direction in relation to said lower frame part, so that the height of said backrest can be adjusted.

19. The chair upper unit according to claim 16, wherein said backrest comprises a lower frame portion and an upper frame portion, said upper frame portion being detachably attached to said lower frame portion, so that second upper portion of said backrest can be removed for significantly reducing the height of said chair upper unit when transporting said chair upper unit.

20. The chair upper unit according to claim 16, wherein the backrest comprises:

first and second backrest side frame portions, said first side frame portion attached to said first side frame of said seat part and said second side frame portion attached to said second side frame of said seat part; and backrest intermediate portions attached to said backrest side frame portions and connecting said backrest side frame portions to each other; and wherein said backrest intermediate frame portions have adjustable lengths so that in setting the width of said seat part by adjusting said side frames of said seat part the lengths of said backrest intermediate frame portions can be adjusted at the same time so that the width of said backrest is adjusted.

21. The chair upper unit according to claim 20, further comprising angularly adjustable hinged joints between said backrest side frame portions and said side frames of said seat part.

22. The chair upper unit of claim 16, wherein said backrest comprises backrest side frame portions which are adjustably attached to each other so that the distance therebetween can be changed thereby changing the width of said backrest.

23. The chair upper unit of claim 22, wherein said backrest further comprises first and second thin stiff plates, said first plate primarily resting at a side of said chair upper unit, on said first backrest side frame portion, and said second plate primarily resting at a side of said chair upper unit on said second backrest side frame portion, said backrest plates or base plates being interconnectable and slidable with respect to each other to change the width of said backrest.

24. A chair upper unit comprising:

a backrest; and a seat part having an upper surface which is adapted to engage the buttocks of a person seated in the chair upper unit, said seat part comprising:

a support attachable to a chair base;

a central frame connected to said support and having first and second sides;

first and second side frames, said first side frame provided at said first side of said central frame, and said second side frame provided at said second side of said central frame, wherein each of said side frames is adjustably attached to said central frame so that by adjusting at least one of said side frames the width of said upper surface of said seat part is changed; and a front frame forming a front edge, said front frame disposed at the front of said central frame and adjustably connected to said central frame in a forward and backward direction, so that by adjusting said front frame in the forward and backward direction, said front edge of said seat part is placed in different positions in relation to said support and thereby in relation to a chair base, to which said chair upper unit is attached, so that the position of the center of gravity of a person resting in said chair upper unit can be adjusted in relation to said support.

25. The chair upper unit according to claim 24, wherein said seat part further comprises first and second thin stiff plates forming said upper surface of said seat part, said first plate resting, at least at an outermost portion thereof located at a first side of the chair upper unit, on said first side frame and said second plate resting, at least at an outermost portions thereof located at a second, opposite side of the chair upper unit, on said side frame, said first and second plates being slidable with respect to each other when setting the width of said upper surface of said seat part by adjusting at least one of said side frames with respect to said central frame.

26. The chair upper unit according to claim 24, wherein said backrest comprises a lower frame portion and an upper frame portion, said upper frame portion being attachable in different vertical positions in a height direction in relation to said lower frame portion, so that the height of said backrest can be adjusted.

27. The chair upper unit according to claim 24, wherein said backrest comprises a lower frame portion and an upper frame portion, said upper frame portion being detachably attached to said lower frame portion, so that said upper frame portion of said backrest can be removed for significantly reducing the height of said chair upper unit when transporting said chair upper unit.

28. The chair upper unit according to claim 24, wherein said seat part further comprises:

a lower frame rigidly attached to said support, said lower frame positioned below said central frame and hinged to said central frame, and an adjustment mechanism connected to said lower frame and said central frame which adjusts said central frame to take different angles in relation to said lower frame.

29. The chair upper unit according to claim 28, wherein said seat part further comprises first and second thin stiff plates forming said upper surface of said seat part, said first plate resting, at least at an outermost portion thereof on said first side frame, and said second plate resting, at least at an outermost portion thereof, on said side frame, said first and second plates being slidable with respect to each other when setting the width of said upper surface of said seat part by adjusting at least one of said side frames with respect to said central frame.

30. The chair upper unit according to claim 24, wherein said seat part further comprises a rear frame forming a rear edge of said seat part, said rear frame disposed at the rear of said central frame and adjustably connected to said central frame, so that by adjusting said rear frame said rear edge of said seat part is placed in different positions in relation to said support and thereby in relation to a chair base, to which the chair upper unit is attached, so that the position of the center of gravity of a person resting in said chair upper unit can be adjusted in relation to said support.

31. The chair upper unit according to clam 30, wherein said seat part further comprises a thin stiff plate forming part of said upper surface of said seat part, and engaging said rear frame.

32. The chair upper unit according to claim 24, wherein said backrest comprises:

first and second backrest side frame portions, said first side frame portion attached to said first side frame of said seat part and said second side frame portion attached to said second side frame of said seat part; and backrest intermediate portions attached to said backrest side frame portions and connecting said backrest side frame portions to each other; and wherein said backrest intermediate frame portions have adjustable lengths so that in setting the width of said seat part by adjusting said side frames of said seat part, the lengths of said backrest intermediate frame portions can be adjusted at the same time so that the width of said backrest is adjusted.

33. The chair upper unit according to claim 32, further comprising angularly adjustable hinged joints between said backrest side frame portions and said side frames of said seat part.

34. The chair upper unit of claim 24, wherein said backrest comprises, first and second backrest side frame portions which are adjustably attached to each other so that the distance therebetween can be changed thereby changing the width of said backrest.

35. The chair upper unit of claim 34, wherein said backrest further comprises first and second thin stiff plates, said first plate primarily resting at a side of said chair upper unit, on said first backrest side frame portion, and said second plate primarily resting at a side of said chair upper unit on said second backrest side frame portion, said plates being interconnectable and slidable with respect to each other to change the width of said backrest.

* * * * *

UNITED STATES PATENT AND TRADEMARK OFFICE

CERTIFICATE OF CORRECTION

PATENT NO. : 6,352,307 B1
DATED : March 5, 2002
INVENTOR(S) : Engman

It is certified that error appears in the above-identified patent and that said Letters Patent is hereby corrected as shown below:

Title page,
Item [30], please insert -- [30] Foreign Application Priority Data

Nov. 15, 1995 [SE] Sweden 9504083-8 --.

Signed and Sealed this

Twenty-sixth Day of November, 2002

*Attest:*

*Attesting Officer*

JAMES E. ROGAN
*Director of the United States Patent and Trademark Office*